US008162687B2

(12) United States Patent
Dawiedczyk et al.

(10) Patent No.: US 8,162,687 B2
(45) **Date of Patent: *Apr. 24, 2012**

(54) CONNECTOR SYSTEM WITH GUIDE

(75) Inventors: Daniel L. Dawiedczyk, Naperville, IL (US); Jamie Duran, Chicago, IL (US); Jay H. Neer, Boca Raton, FL (US); Cleaver Brinkerhoff, Wilmington, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/535,115

(22) Filed: Aug. 4, 2009

(65) Prior Publication Data

US 2009/0291572 A1 Nov. 26, 2009

Related U.S. Application Data

(60) Continuation of application No. 12/221,339, filed on Aug. 1, 2008, now Pat. No. 7,997,922, which is a division of application No. 11/246,508, filed on Oct. 7, 2005, now Pat. No. 7,413,461.

(60) Provisional application No. 60/637,013, filed on Dec. 17, 2004, provisional application No. 60/704,698, filed on Aug. 2, 2005.

(51) Int. Cl.
*H01R 13/627* (2006.01)

(52) U.S. Cl. ..... 439/357; 439/607.4

(58) Field of Classification Search ..... 439/101, 439/108, 350, 354, 357, 358, 374, 607.4
See application file for complete search history.

(56) References Cited

U.S. PATENT DOCUMENTS

| | | | |
|---|---|---|---|
| 3,692,966 | A | 9/1972 | Lancaster |
| 3,737,833 | A | 6/1973 | Jerominek |
| 4,376,565 | A | 3/1983 | Bird et al. |
| 4,678,121 | A | 7/1987 | Douty et al. |
| 4,907,991 | A | 3/1990 | Kobayashi |
| 4,986,769 | A | 1/1991 | Adams et al. |
| 5,108,294 | A | 4/1992 | Marsh et al. |
| 5,122,065 | A | 6/1992 | Dudek et al. |
| 5,238,411 | A | 8/1993 | Jinno et al. |
| 5,332,397 | A | 7/1994 | Ingalsbe |
| 5,816,842 | A | 10/1998 | Thantrakul et al. |
| 5,934,935 | A | 8/1999 | Kameyama |
| 5,955,703 | A | 9/1999 | Daly et al. |
| 5,993,258 | A | 11/1999 | Matsunuma et al. |
| 6,186,807 | B1 | 2/2001 | Simmel |
| 6,215,666 | B1 | 4/2001 | Hileman et al. |
| 6,435,897 | B1 | 8/2002 | Paul et al. |
| 6,439,901 | B1 | 8/2002 | Ji et al. |
| 6,508,660 | B2 | 1/2003 | Self |
| 6,824,429 | B2 | 11/2004 | Hwang |
| 6,902,432 | B2 | 6/2005 | Morikawa et al. |
| 7,175,444 | B2 | 2/2007 | Lang et al. |
| 7,226,314 | B2 | 6/2007 | Lang et al. |
| 7,303,438 | B2 | 12/2007 | Dawiedczyk et al. |

(Continued)

OTHER PUBLICATIONS

International Search Report for PCT/US2005/044755, Mar. 20, 2006.

*Primary Examiner* — Felix O Figueroa
(74) *Attorney, Agent, or Firm* — Stephen L. Sheldon

(57) ABSTRACT

A connector guide mounted in front of a receptacle connector is provided. The guide may include a press arm that helps urge a mating connector into a desired alignment. The guide is separate from the receptacle connector and serves to align contact surfaces and provide strain relief to the receptacle connector.

9 Claims, 6 Drawing Sheets

U.S. PATENT DOCUMENTS

| | | | |
|---|---|---|---|
| 7,344,409 | B2 | 3/2008 | Lang et al. |
| 2003/0129864 | A1 | 7/2003 | Peloza |
| 2006/0014438 | A1 | 1/2006 | Regnier et al. |
| 2008/0085633 | A1 | 4/2008 | Dawiedczyk et al. |
| 2008/0166899 | A1 | 7/2008 | Lang et al. |

FIG.4
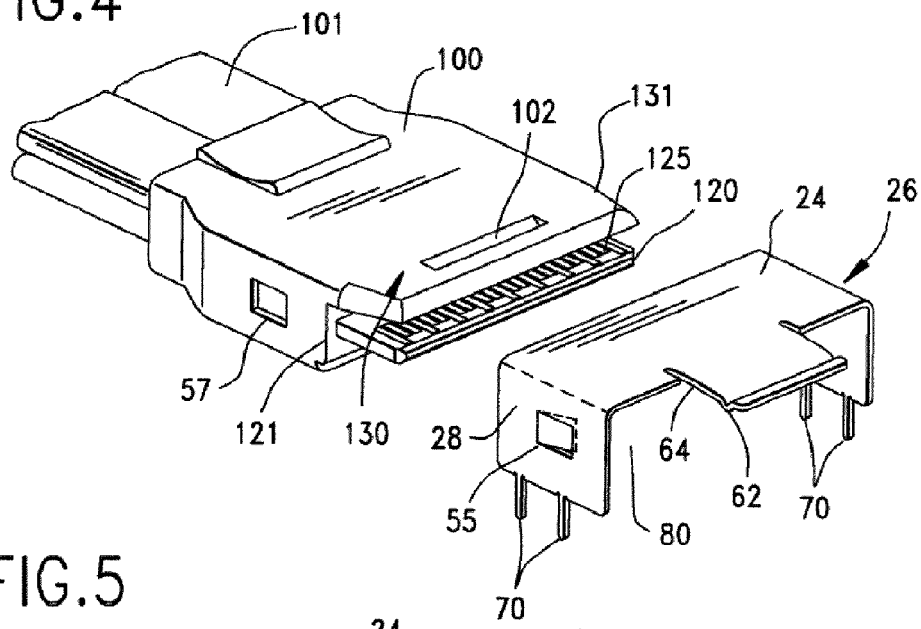
FIG.5
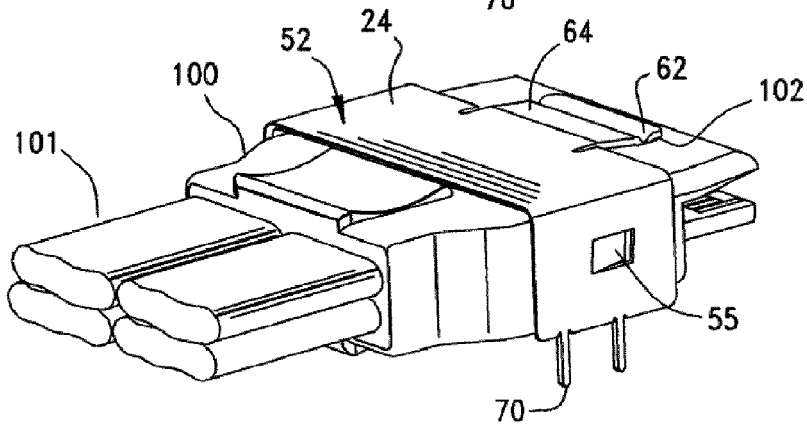
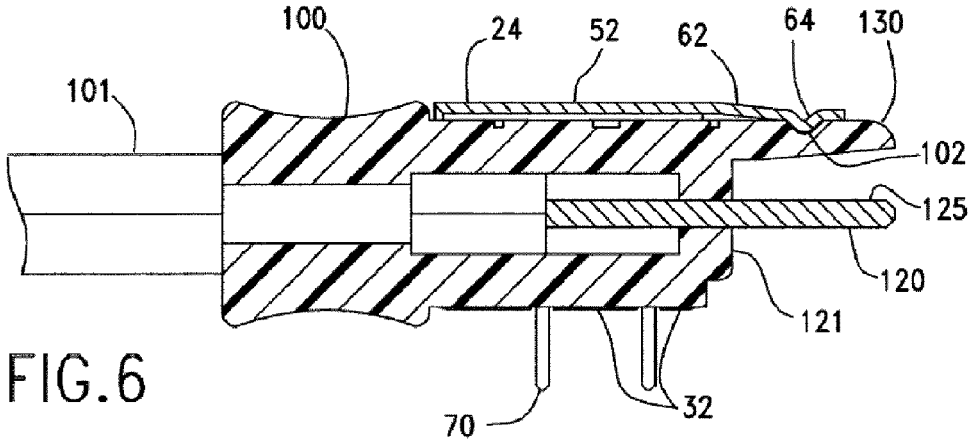
FIG.6

CONNECTOR SYSTEM WITH GUIDE

REFERENCE TO RELATED APPLICATIONS

This application is a continuation of U.S. Ser. No. 12/221,339, filed Aug. 1, 2008 now U.S. Pat. No. 7,997,922, which is incorporated herein by reference in its entirety and which is a divisional of U.S. application Ser. No. 11/246,508, filed Oct. 7, 2005, now U.S. Pat. No. 7,413,461, which in turn claims priority of U.S. Provisional Patent Application Nos. 60/637,013, filed Dec. 17, 2004 and 60/704,698, filed Aug. 2, 2005.

BACKGROUND OF THE INVENTION

The present invention relates generally to cable connectors and more particularly to cable connectors that have a structure which eliminates the need for a shielding cage or guide frame to be utilized with a mating circuit board connector.

It is a common practice in the electronic arts to connect cables to a circuit boards by terminating the cables to a connector, typically a plug connector, and then mating the connector to a receptacle connector that is mounted on a circuit board. A well-known problem with connecting cables to circuit board-mounted connectors is the tendency of the weight and movement of the cable to loosen the points of attachment of the receptacle connector to the circuit board, thereby breaking signal pathways and causing the circuit board to fail.

This may be prevented by the use of a large guide frame that is mounted to the circuit board to enclose the receptacle connector and which defines an opening into which a plug or similar connector may be inserted. However, such guide frames are large and take up valuable space on the circuit board that could be used for additional circuits or terminations. Additionally, such guide frames are typically die cast and are prone to breakage when dropped.

Connector receptacle strain is also a problem and may be caused by the weight, size and movement of the cable(s). Still further, a connector plug and its mating connector receptacle can sometimes be misaligned with respect to each other, needlessly complicating an assembly process. Accordingly, a device that aligns a plug connector to its mating connector receptacle without occupying much space and which could also relieve cable strain imposed on a circuit board-mounted connector is desirable.

Additionally, the use of large connector guide frames increases the space on a circuit board that can be used for other electronic components. And furthermore, guide frames are designed to totally encircle and house the connector(s) they are hosting.

Accordingly, the present invention is directed to an arrangement using a guide member that overcomes the aforementioned disadvantages and also provides the aforementioned desired benefits.

SUMMARY OF THE INVENTION

Accordingly, it is a general object of the present invention to provide a guide assembly for a surface mount connector which guides a plug connector into an opposing receptacle connector and which at least partially retains the plug connector in connection with the receptacle connector.

Another object of the present invention is to provide an alignment guide member for guiding a connector plug into mating engagement with a surface receptacle mounted connector and maintaining alignment between the plug connector and the receptacle connector.

Another object of the present invention is to provide an electrical connector assembly for mounting to a circuit board or other substrate, having a receptacle connector that electrically couples electrical pathways on a circuit board to electrical contacts to which a plug connector may be mated and a guide member that aligns and guides the plug connector into mating engagement with the receptacle connector and which can provide strain relief to the receptacle connector.

Still another object of the present invention is to provide a guide member for a surface-mounted receptacle connector which eliminates the need to use a guide frame with the receptacle connector, the guide member being formed from a conductive material and forming an hollow passage that may be attached to a circuit board proximate to the mating end of the receptacle connector, the guide member including means for providing a frictional fit with a plug connector and the guide member further including a retention tab that extends from the guide member toward the receptacle member to define a point of contact between the guide member and a plug connector inserted into the guide member.

Yet a further object of the present invention is to provide a plug connector for use with the aforementioned receptacle connector and guide member, the plug connector including a mating face with forwardly projecting mating blade that fits into a corresponding slot in the receptacle connector, the plug connector further including a projecting tab that extends above and forward of the plug connector mating face, the tab having a recess that receives a corresponding tab of the guide member therein and the plug connector tab extending above the housing of the receptacle connector when mated thereto.

A still further object of the present invention is to provide a guide member for a surface-mounted, vertically-oriented edge receptacle connector in which the guide member includes a guide portion formed from a conductive material, such as sheet metal that forms an open channel directed toward the mating face of the receptacle connector, and the guide member including an engagement portion that engages an opposing portion of the plug connector.

The present invention accomplishes these and other objects and aspects by virtue of its structure, which in one principal aspect includes a guide for guiding a connector plug into a circuit board-mounted connector. The connector guide in a preferred embodiment includes a U-shaped guide member that is inverted when it is mounted to a circuit board or similar substrate and is located in front of and spaced apart from a receptacle connector. A plug connector is inserted into the guide member and it directs and aligns the plug portion of the plug connector with the receptacle connector.

The U-shaped guide member, in the preferred embodiment, has two opposing planar side plates that extend orthogonally to a planar top plate. The side plates may include one or more tabs that are stamped from the guide member and which project into its interior so as to frictionally contact the plug connector housing when the plug connector is inserted into the guide member. The distance that these tabs extend into the interior of the guide member may also serve as an alignment function by directing the plug connector toward the center of the guide member. When a plug connector is inserted into the guide member and the receptacle connector, these tabs contact the sides of the plug connector and slow the insertion movement.

The guide member may also include an extension in the form of a spring arm that extends preferably from the top plate thereof. The spring arm may extend into the space between the guide and the receptacle connector or it may extend slightly over the top of the receptacle connector. The free end of the spring arm may be formed so as to define a detent thereon which engages a slot or channel formed on the top of the plug connector to provide a tactile means for indicating to the use that the plug connector is properly inserted into and mated with the receptacle connector.

In an alternate embodiment, the guide member is used in a vertical orientation in association with a vertical receptacle connector. This embodiment also takes a general U-shape and the top plate (which extends vertically along one of the sides of the receptacle connector) may be provided with a spring arm that is stamped from the top plate and which resides within the boundaries of the top plate. In another vertical embodiment, the guide extends above the receptacle connector mating area and defines a hollow passage into which the plug connector is inserted.

These and other objects, features and advantages of the present invention will be clearly understood through a consideration of the following detailed description.

BRIEF DESCRIPTION OF THE DRAWINGS

The invention, together with its objects and the advantage thereof may be best understood by reference to the following description taken in conjunction with the accompanying drawings, in which like reference numerals identify like elements in the figures and in which:

FIG. 4 is an enlarged perspective view taken from the front of the front of the connector guide member illustrating the structure of the plug connector and the guide member;

FIG. 5 is an enlarged perspective view taken from the rear of a plug connector that has been inserted into the guide member;

FIG. 6 is a sectional view of FIG. 5 taken along lines 6-6 thereof;

DETAILED DESCRIPTION OF THE PREFERRED EMBODIMENTS

Figure 1:
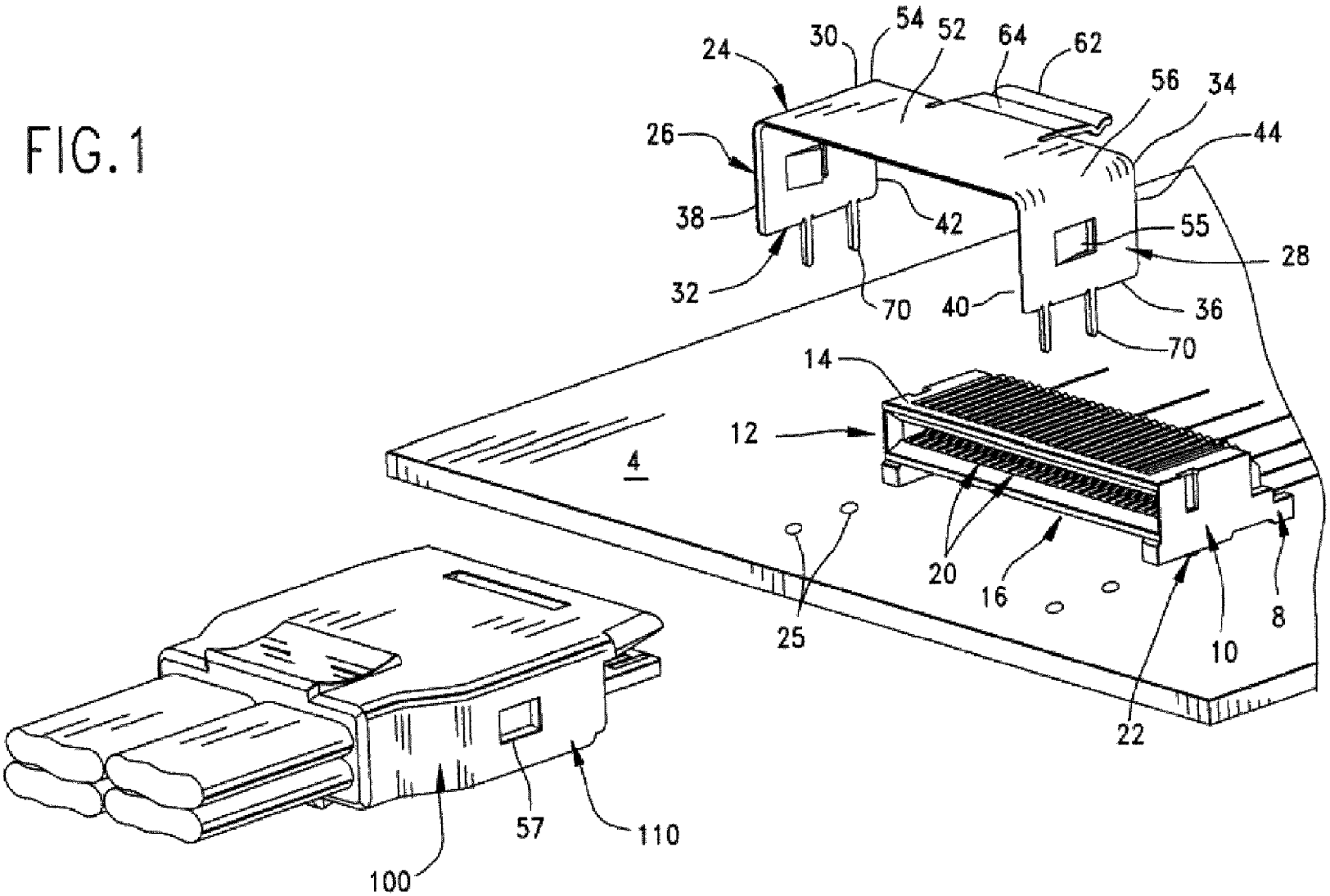
FIG. 1 is an exploded perspective view of an electronics assembly that utilizes a connector guide member constructed in accordance with the principles of the present invention to align a plug connector to a receptacle connector.

FIG. 1 illustrates an exploded view of an electronic assembly 2 that is used to exchange electrical signals between conductive traces 6 of a circuit board, or other substrate, 4 and electrical conductors in a cable 101. In FIG. 1, the electronic assembly 2 shown includes a circuit board 4 to which electronic components such as integrated circuits, resistors, capacitors inductors and the like can be mounted. As is well-known, electronic components mounted to circuit boards are interconnected by one or more electrically conductive traces 6, at least some of which are located on at least a surface of the substrate 4. Electrical signals may be transmitted through the conductive traces 6 by way of a receptacle connector 8 that is mounted to the substrate 4 and which mates with an opposing cable connector.

FIG. 1 shows the receptacle connector 8 attached to the circuit board 4 using either mounting posts, screws or soldered into place as shown, all of which are well-known in the art. The receptacle connector 8 has two opposing sides 10 and 12, a top 14, a bottom 15, a front 16 and a back 18. The receptacle connector 8 is constructed and arranged to maintain the spacing of several electrical front-side accessible contacts 20, each of which is electrically coupled to a corresponding conductive trace 6 on the circuit board 4.

Electrical and mechanical connection to the front-side 16 accessible contacts 20 in the receptacle connector 8 is made by extending a mating connector of the plug type 100 into contact with the receptacle connector 8. The plug connector 100 has its own set of conductive contacts that mate with the receptacle connector contacts 20 and the plug connector is at least partially guided into place by way of a guide member, or shell 24, that is mounted to the circuit board in a location that is forward of and spaced apart from the receptacle connector 8. In a preferred embodiment, the guide member 24 is substantially U-shaped and is formed as a hood or shield that is inverted when installed onto the circuit board 4. The guide member 24 defines a hollow channel 80 between it and the circuit board 4 through which the plug connector 100 can extend to engage the mating receptacle connector 8.

As shown in FIG. 1, the connector guide member 24 preferably includes at least two planar sides 26 and 28. One planar side 26 has a top edge 30 and a bottom edge 32 and the second side 28 also has a top edge 34 and a bottom edge 36. Each planar side 26 and 28 further includes a front edge and a back edge. The first side 26 has a front edge 38 and a back edge 42. The second side 28 has a front edge 40 and a back edge 44. Two mounting posts 70 (FIG. 4) are preferably formed in the guide member along the bottoms of the sides and these posts may be cylindrical or may be stamped as part of the guide member itself. No matter what their structure, the posts 70 extend downwardly from the sides 26 and 28 and are received in mounting holes 25 formed in the circuit board 4. They may be used to solder the guide member in place on the circuit board 4 as well as connect it to an ground circuits on the circuit board 4.

Figure 7:
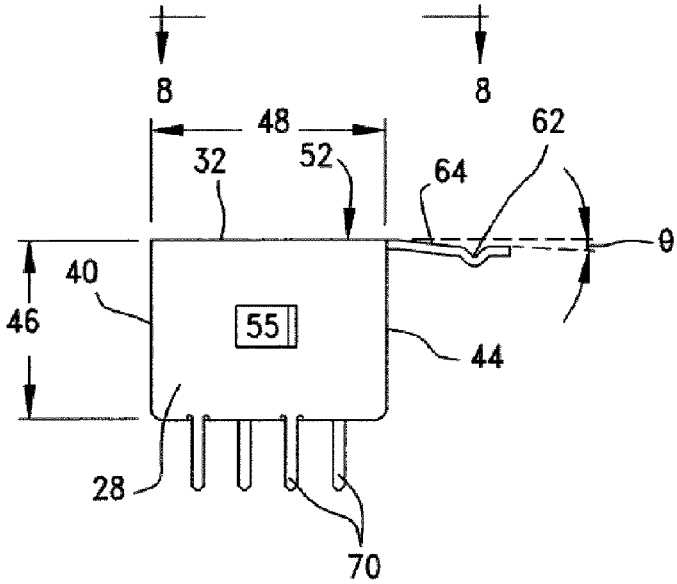
FIG. 7 is a side elevational view of the guide member of FIG. 1.

As seen in FIG. 7, the opposing first and second sides 26 and 28 of the guide member preferably have substantially equal heights 46 between the top and bottom edges and a substantially equal width 48 between the front and back edges of each side. As seen in FIG. 1, the sides 26 and 28 are substantially upright and extend at generally right angles to the planar top 52. Although the horizontal embodiment of the guide member 24 show in FIGS. 1-9 is stamped from a single piece of sheet metal, for purposes of this disclosure, the top 52 and the two sides 26 and 28 may also be joined to each other at common edges. The top 52 has a first side edge 54 shown at its right when viewed from the front as in FIG. 1 and a second side edge 56 shown at its left. The top 52 also has a front edge 58 and a rear edge 60.

Importantly, the guide member 24 may be stamped from a relatively stiff metal in a pattern by which there is formed an extension of the guide member which takes the form of a tab, or spring arm 64, that extends rearwardly. In the drawings, it is shown as extending in a cantilevered fashion, and as shown in FIG. 7, it is preferably formed at a slight downward angle θ that creates a bias or preload in the arm 64. This bias forces a plug engagement portion, shown as ridge or catch 62, located near the distal end of the spring arm 64, into engagement with a corresponding slot or recess 102 that is formed in a corresponding portion of the plug connector. This structure may be used to ensure proper location of the plug connector in place within the guide member 24 and in engagement with the receptacle connector. It also may exert a slight downward force on the top flange of the plug connector.

Figure 2:
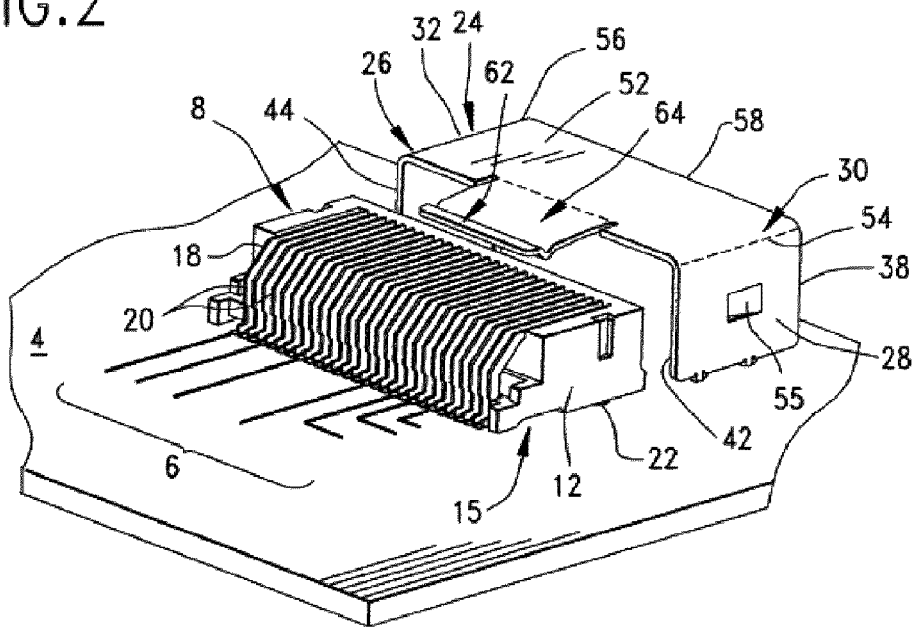
FIG. 2 is a perspective view taken from the rear of the receptacle connector and guide member of FIG. 1.

FIG. 2 is a rear perspective view of the connector receptacle 8 and the relative position of the guide member 24, with respect to the connector plug 8. As shown in FIG. 2, the guide member 24 is mounted to the circuit board 4 so that the guide member 24 is located in a spaced apart fashion from the connector receptacle, i.e., not in contact with it, and in front of the mating face 16 of the receptacle connector 8. FIG. 2 also shows the connective traces 6 on the circuit board 4 and their connection to the electrical contacts 20 of the receptacle connector 8. FIG. 2 also illustrates the presence and location of side locking latch, or engagement tabs 53, that are formed in the side plates 28 by stamping. These engagement tabs 53 extend inwardly, i.e. into the interior of the channel 80 of the guide member 24 they are sized, shaped and arranged to frictionally contact the sidewalls 110 of the plug connector 100 when the plug 100 is inserted into the guide member 24 and engaged with the receptacle connector 8. As shown in FIG. 1, the plug connector may be provided with openings 57 in its sidewalls into which the guide member engagement tabs 55 extend to secure the plug connector in place in position within the guide member 24.

Figure 3:
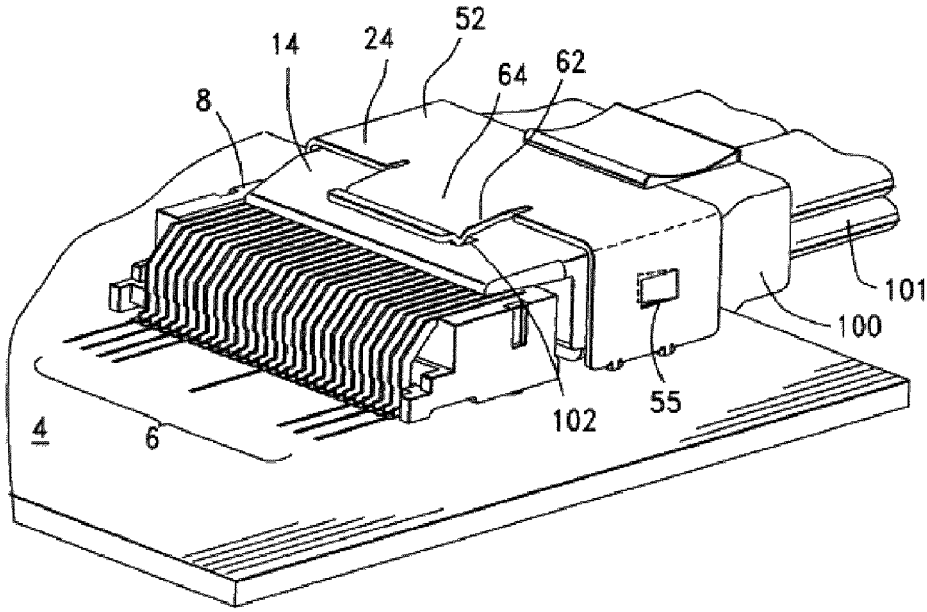
FIG. 3 is the same view shown in FIG. 2, but illustrating a plug connector inserted into the guide member and engaged with both the receptacle connector and guide member.

FIG. 3 illustrates a rear perspective view of an electronic assembly including the circuit board 4, the rear 18 of the receptacle connector 8, the contacts 20 of which establish electrical connections between the board traces 6 and the wires of the cable 101 by way of the plug connector 100 that is installed and latched into place. In FIG. 3, the plug connector 100 is shown extending through the guide member 24 until the spring arm catch portion 62 engages the slot 102 in the top of the plug connector 100. As shown in FIG. 3, this catch portion 62 is located near the distal end, i.e. the end furthest from the point where the spring arm 64 extends away from the rear edge 60 of the top 52 of the guide member 24. The catch portion 62 may also be aligned with the contacts on the circuit card mating blade so as to ensure appropriate pressure to maintain contact between the plug connector and its opposing receptacle connector.

Those of ordinary skill in the art will recognize that the length of the spring arm 64 is chosen to enable the mechanical coupling of the catch 62 with the plug connector slot 102. FIG. 4 shows a front perspective view of the guide member 24 and the relative location of a connector 100 prior to its insertion into the guide member 24. FIG. 4 omits the depiction of the circuit board 4 for clarity. In this Figure, the connector plug 100 is clearly shown to have a connector latch slot 102, cut, molded or otherwise formed in the body of the connector 100 and positioned to accept the catch 62 when the connector 100 is fully engaged with a connector plug (not shown in FIG. 4). It can be seen that the plug connector includes an edge card 120 that extends out from a forward mating face 121 of the plug connector 100. This edge card 120 has a plurality of conductive traces 125 disposed thereon that mate with the contacts 20 of the receptacle connector when the plug connector is inserted into the receptacle connector. The plug connector housing may also include an extension portion, or flange 130, that extends forward from the mating face 121 and over the edge card 120. This flange 130 extends also widthwise for the full width of the edge card and also serves to protect the edge card for stubbing. It also provides a support for the recess 102 and further extends over the top of the receptacle connector to provide a means of restricting the entrance of contaminants onto the receptacle connector.

FIG. 4 also shows a side locking latch 55 formed in one side 28 of the guide member 24. In a preferred embodiment, the side locking latch 55 is formed simply by stamping the metal from which the connector alignment guide is formed such that a small tab is formed in the side that extends toward the opposite side 26 and which engages a corresponding side detent 57 formed into a corresponding side of a mating plug connector 100. Those of ordinary skill in the art should appreciate that when the connector plug 100 is fully engaged to its complimentary connector receptacle, the side locking latch 55 (which is actually on both sides 26 and 28 of the guide member 24), will engage its corresponding detent 57 and "latch" the connector plug 100 to the connector receptacle 8. That the latching is accomplished by the guide member 24 and not the connector receptacle 8 means that cable strain is absorbed by the guide member 24 and not the connector receptacle 8. In addition, any misalignment of the conductors in the plug 100 and the receptacle 8 is minimized by the plug-to-receptacle alignment performed by the guide member 24. These two side latches 55 and the top press arm form a three way means of engagement with the plug connector 100.

FIG. 5 is a rear perspective view of the connector 100 that is fully inserted into the guide member 24. In this Figure, the guide member catch 62 is in interlocking engagement with the slot 102 in the connector 100. A deflection or "bias" in the spring arm 64 urges the catch 62 into the engagement slot 102 when the plug connector 100 is fully inserted into the guide member 24. Similarly, the side locking latch 55 (one shown on one side) because it is bent inwardly, may extend into the plug connector recesses 57 to preventing the plug connector 100 from being removed without any significant pull out force. When the plug connector 100 is so connected to the receptacle connector 8, the guide member 24 also provides a measure strain relief and conductor alignment.

FIG. 6 is a partial cutaway view of the connector 100 when installed into the connector alignment guide 24. In this figure, the interlocking engagement of the plug engagement latch 62 is clearly shown on the right-hand side of the drawing. It can be seen that the engagement latch 62, which is biased downwardly and into the slot 102 of the plug connector 100, acts to keep the connector 100 in alignment within the guide member 24. Also shown in this Figure are two mounting posts 70 that are connected to the bottom edges 32 of the connector guide sides 26 and 28 and which are used to electrically and mechanically mount the alignment guide 24 to a circuit board or other substrate 4.

FIG. 7 is a side view of the guide member 24. This Figure shows the side walls to be substantially rectangular with a height 46 that is the distance between the top edge 32 and the bottom edge 36 of the side 28 shown in this figure. Similarly, this Figure shows the width 48 to be the distance between the front and rear edges 40 and 44. The mounting posts 70 are also shown as is the top 52 of the guide member 24.

FIG. 7 also shows the downwardly-oriented (and acute) angle θ between the plane of the top surface 52 and the press, or spring arm 64. The spring arm 64 is biased downwardly as shown to provide assurance that the catch 62 will meet with and engage the plug connector slot 102 tending to hold the plug connector 100 in engagement with its mating receptacle connector.

Figure 8:
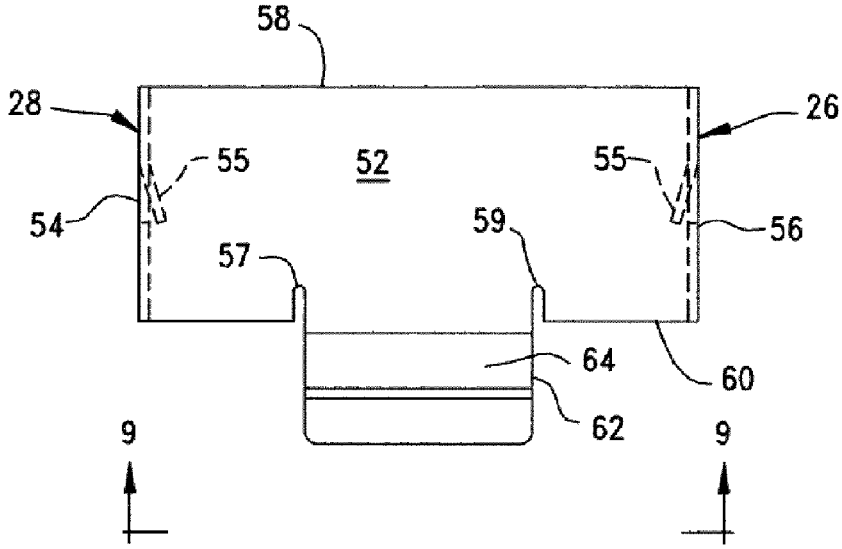
FIG. 8 is a top plan view of the guide member of FIG. 7.
Figure 9:
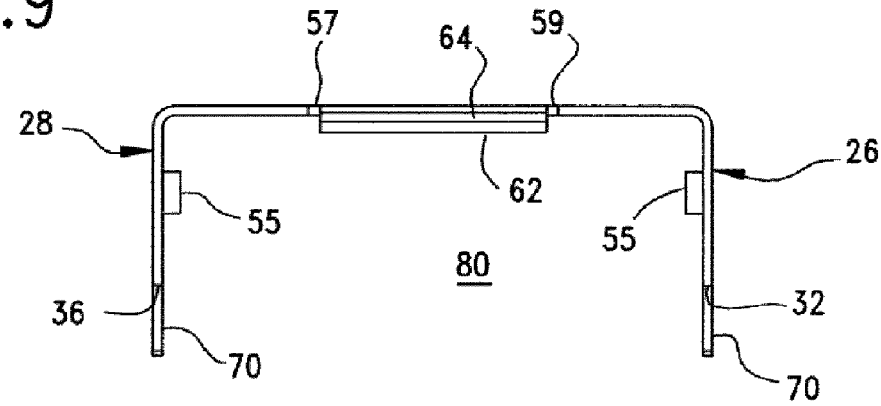
FIG. 9 is a rear elevational view of the guide member of FIG. 7.

FIG. 8 shows a top view of the guide member 24. In particular, this view shows the structure of the side locking latches 52 that are stamped into both sides 26 and 28 of the guide member 24. This figure also shows two cutouts 57 and 59 on either side of the spring arm 64 which provide additional flexibility to the spring arm 64. Finally, FIG. 9 shows a rear view of the guide member 24. In this view, the extension of the locking latches 55 are clearly seen as extending into the U-shaped channel 80 that lies within the two opposing sides 26 and 28 and under the substantially planar top 52. This figure also shows the attachment posts 70 that extend away from the bottom edge 36 and 32 of the sides 28 and 26 respectively.

From the forgoing, it should be apparent to those of ordinary skill in the art that when the U-shaped guide member 24 is attached to a circuit board 4, it can envelop a plug connector and lock it in place thereby absorbing cable strain and providing electrical contact alignment, even though the guide member 24 is electrically and mechanically separated from and not connected to the connector receptacle 8. The catch 62 and in alternate embodiments, the side engagement tabs 55, keep the plug connector in place within the guide member 24.

In the preferred embodiment, the guide member is stamped from a relatively stiff metal. Alternate embodiments of course may include molded plastic to comprise the shape set forth above with an optional metal coating.

It should be understood that the invention may be embodied in other specific forms without departing from the spirit hereof. For example, although the guide member 24 is shown to be substantially rectangular, an alternate and equivalent embodiment would include using a top panel of a non-rectangular shape. Similarly, the side panels do not need to be rectangularly shaped as shown. The spring arm 64 shown in the Figures is also substantially rectangular. Alternate and equivalent embodiments would include a spring arm formed of one or more cantilevered bars or rods.

The side locking latches shown are formed by inwardly stamping a localized area of the side of the guide member, leaving one edge of the area in place, so that the stamped area can be bent inwardly as shown. Alternate and equivalent embodiments would include using sheet metal or machine screws through the sides and into the connector 100 when it is installed into the connector guide and latched with the plug connector.

Figure 10:
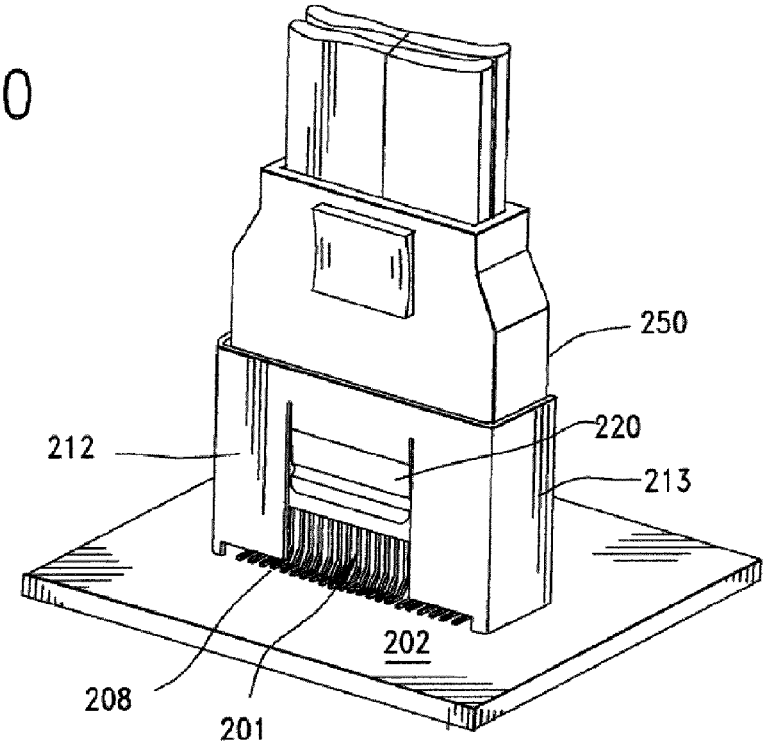
FIG. 10 is a perspective view of an alternate embodiment of a vertical guide member that is used is conjunction with a vertical, surface-mounted receptacle connector.
Figure 11:
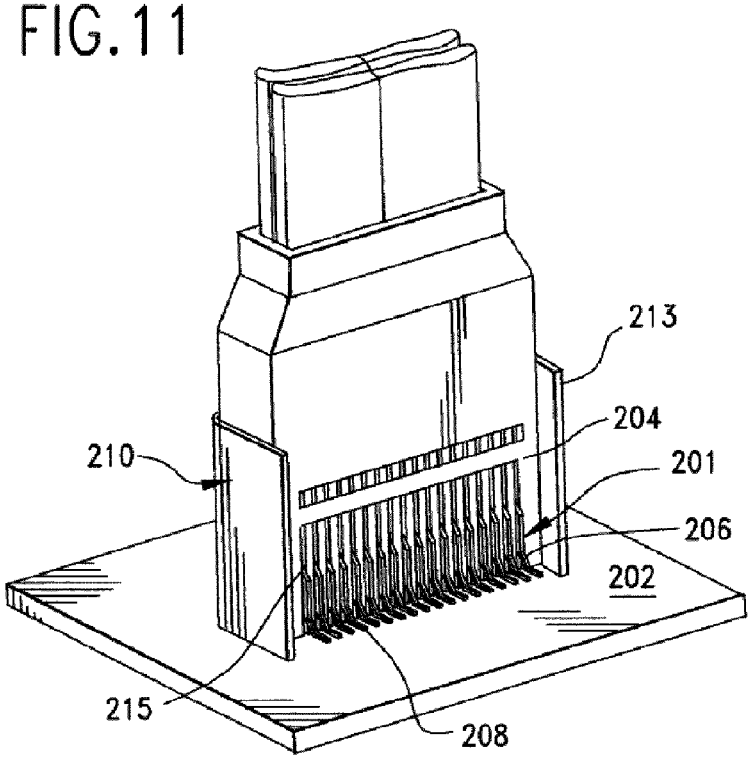
FIG. 11 is the same view as FIG. 10, but taken from the opposite side thereof.

FIGS. 10 & 11 illustrate another embodiment 200 of a connector guide assembly constructed in accordance with the principles of the present invention and which is intended for a vertical use on a circuit board. As shown in the Figures, the receptacle connector 201 is surface-mounted in a vertical format to a circuit board 202. The connector 201 has an insulative housing 204 and supports a plurality of conductive terminals 206. The terminals 206 have tail portions 208 that are soldered to pads or traces on the surface of the circuit board 202. A conductive guide member 210 is provided for use with the connector and it can be seen that the guide member 210 has a general U-shape with a top plate 212 that has two side plates 213 that extend from at transversely. These three plates cooperatively define a channel 215 which extends partially around and above the receptacle connector 201. The top plate 212 of the guide member is slotted and has a recess 218 into which a catch member 220 extends. This catch member has a bend 221 formed in it that preferably engages a slot (not shown) on the plug connector housing 250 in the same manner as shown for the first embodiment.

Figure 12:
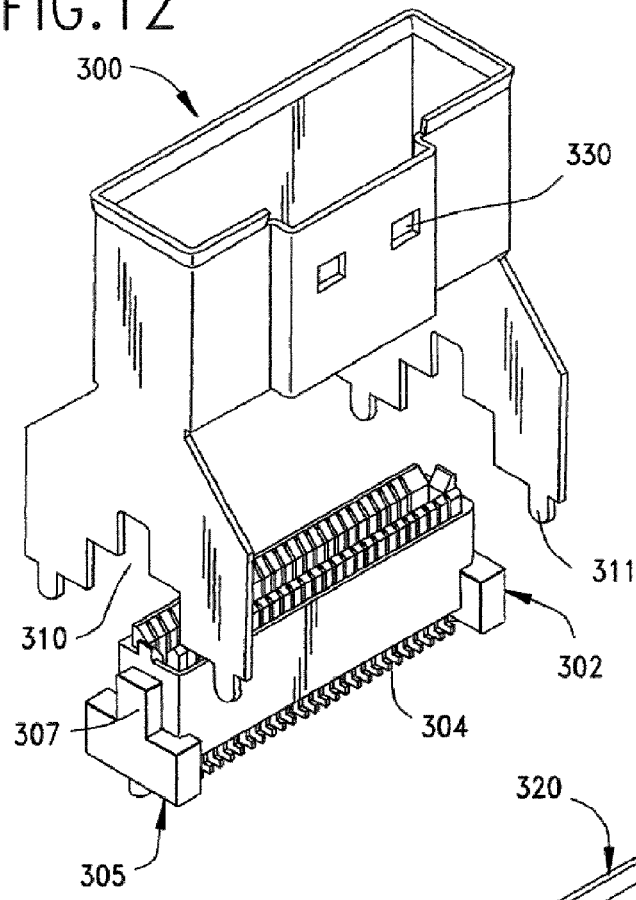
FIG. 12 is an exploded view of another embodiment of a vertically mounted receptacle connector and a vertical guide member; and, FIG. 13 is the same view as FIG. 12, but with the guide member in place over the receptacle connector.
Figure 13:
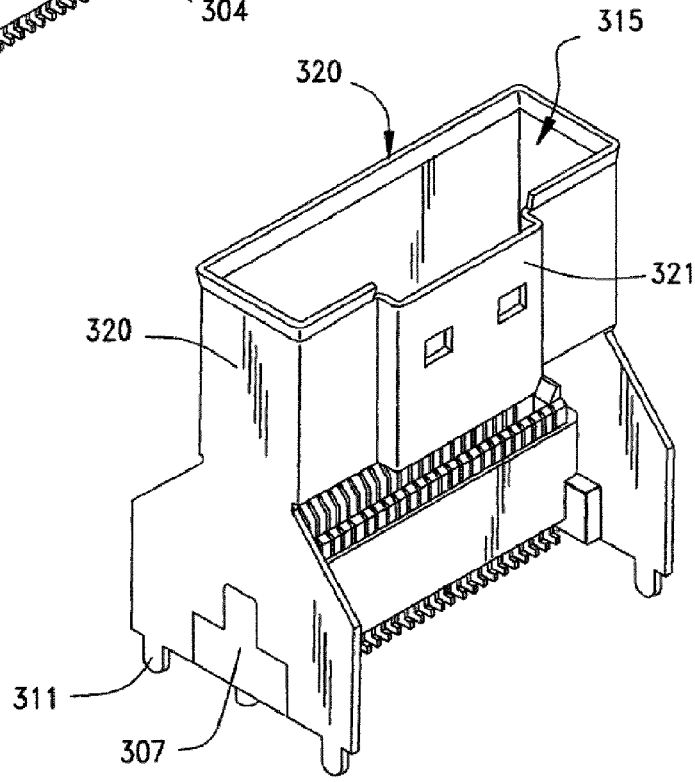

FIGS. 12 & 13 show another embodiment of a vertically oriented guide member 300 that is mounted to a circuit board (not shown) above and in partial contact with a receptacle connector 302, which is mounted to a circuit board by soldering its terminal tails 304 in a known manner, in which the guide member has four walls that cooperate to provide its plug connector channel. The connector housing 305 has a pair of bosses 307 formed at its side ends which are received in openings 310 that are formed in the side ends of the guide member 300. The guide member also has mounting legs 311 for engaging holes in the circuit board and for fixing the guide member to the board. The guide member 30 has a plurality of interconnected walls 320, 321 that cooperatively define a hollow passage 315 that is supported above and away from the mating face of the receptacle connector. One of the side walls 321 (preferably end walls of the guide member) may have slots 330 formed therein for engaging posts or tabs on the plug connector, or latch tabs that are formed on the plug connector (not shown). The guide member may also have, as illustrated a step portion that may be used to accommodate a raised portion of the plug connector in order to orient the plug connector for proper mated connection to the receptacle connector 302. In this embodiment, the wall at the rear of the guide member includes a press arm of similar structure as shown in FIGS. 4 through 10.

While the foregoing described a receptacle connector 8 mounted on a circuit board 4 and depicted the connector receptacle as a female connector, an alternate and equivalent embodiment includes mounting a male-type connector plug on the circuit board and using a female connector on the end of the cable 101. Therefore, the term "receptacle connector" should be understood to include connectors of both genders, i.e., male and female and the term "plug connector" should be understood to include mating connectors of the opposite gender used on the substrate, i.e., female and male.

The present examples and embodiments therefore are to be considered in all respects as illustrative and not restrictive. The invention should not be limited to the details given herein but is instead defined by the claims set forth below.

The invention claimed is:

1. A connector assembly for connecting a mating connector to a plurality of circuits on a circuit board, comprising:

a housing including a mating face and a mounting face, the mating face including at least one circuit-card receiving slot disposed thereon;

a plurality of conductive terminals supported by the housing, each of the plurality of terminals including a contact portion and a tail portion disposed at opposing ends thereof, the contact portion of the plurality of conductive terminals being disposed on opposite sides of the circuit-card receiving slot and the tail portion being disposed along the mounting face; and a connector guide including a including a first wall, a second wall and a third wall that collectively define an enclosure with a front edge that defines a beginning of the enclosure and a rear edge that defines an end of the enclosure, the enclosure having an area that extends from the front edge to the rear edge, the first and second walls including body portions opposing each other, the first and second walls further including bottom portions that extend away from the body portions for contacting the circuit board to which the connector guide is mounted; the connector guide further including a press arm formed in the third wall and extending rearward of the rear edge of the enclosure and extending at least partially into an extension of the area defined by the first, second, and third walls, the press arm having a free end configured to contact an opposing portion of a plug connector when the plug connector is inserted into the connector guide.

2. The connector assembly of claim 1, wherein the press arm includes a distal end and a catch is disposed proximate to the distal end.

3. The connector assembly of claim 1, wherein the connector guide provides an inverted, U-shaped channel.

4. The connector assembly of claim 1, wherein the press arm includes a distal end that extends rearwardly over the housing and past the mating face.

5. The connector assembly of claim 1, wherein the first and second walls each include an engagement member that is configured to frictionally engage a mating connector when the mating connector is inserted into the guide.

6. The connector assembly of claim 1, wherein the sides walls end in front of the mating face.

7. The connector assembly of claim 1, wherein the connector guide has at least one mounting post configured to be inserted into a circuit board, the mounting post positioned between the front edge and rear edge of the guide frame and forward of the mating face.

8. A connector assembly, comprising:

a housing including a mating face and a mounting face, the mating face including at least one circuit-card receiving slot disposed thereon;

a plurality of conductive terminals supported by the housing, each of the plurality of terminals including a contact portion and a tail portion disposed at opposing ends thereof, the contact portion of the plurality of conductive terminals being disposed on opposite sides of the circuit-card receiving slot and the tail portion being disposed along the mounting face; and a connector guide first, second, third and fourth walls that collectively define a four-sided enclosure with a front edge that defines a beginning of the enclosure and a rear edge that defines an end of the enclosure, the enclosure having an area that extends from the front edge to the rear edge, the first and second walls including body portions opposing each other and the third and fourth walls including body portions opposing each other, the first and second walls further including bottom portions that extend away from the body portions for contacting the circuit board to which the connector guide is mounted; the connector guide further including a press arm formed in the third wall and extending rearward of the rear edge of the enclosure and extending at least partially into an extension of the area defined by the first, second, third and fourth walls, the press arm having a free end configured to contact an opposing portion of a plug connector when the plug connector is inserted into the connector guide.

9. The connector of claim 8, wherein the rear of the connector guide is positioned in front of the mating face.

* * * * *